US007222712B2

(12) United States Patent
Liu et al.

(10) Patent No.: US 7,222,712 B2
(45) Date of Patent: May 29, 2007

(54) DOCUMENT VALIDATOR WITH LOCKING CASSETTE

(75) Inventors: Donald Pakman Liu, Las Vegas, NV (US); Raymond Waiman Lui, Las Vegas, NV (US)

(73) Assignee: Valtech International, LLC, Las Vegas, NV (US)

( * ) Notice: Subject to any disclaimer, the term of this patent is extended or adjusted under 35 U.S.C. 154(b) by 152 days.

(21) Appl. No.: 10/795,639

(22) Filed: Mar. 8, 2004

(65) Prior Publication Data

US 2004/0211644 A1 Oct. 28, 2004

Related U.S. Application Data

(60) Provisional application No. 60/457,153, filed on Mar. 24, 2003.

(51) Int. Cl.
*G07F 7/04* (2006.01)
*E05G 1/00* (2006.01)

(52) U.S. Cl. ..... 194/350; 109/47; 70/DIG. 20

(58) Field of Classification Search ..... 194/350, 194/206, 207; 235/380; 70/1, 78, 79, 85, 70/70, 71, 86, 81, DIG. 20; 463/21, 46, 463/47; 109/47, 24.1; 312/215, 334.44
See application file for complete search history.

(56) References Cited

U.S. PATENT DOCUMENTS 4,587,434 A * 5/1986 Roes et al. ..... 250/556
4,725,823 A * 2/1988 Persson ..... 340/571
4,728,096 A 3/1988 Winkler et al.
5,308,992 A * 5/1994 Crane et al. ..... 250/556
5,498,879 A * 3/1996 De Man ..... 250/556
5,527,031 A 6/1996 Walsh et al.
5,662,201 A 9/1997 Gerlier et al.
5,678,678 A 10/1997 Brandt, Jr. et al.
5,740,897 A 4/1998 Gauselmann
5,944,396 A * 8/1999 Stephan ..... 312/204
5,947,255 A * 9/1999 Shimada et al. ..... 194/207
5,992,601 A * 11/1999 Mennie et al. ..... 194/207
5,996,314 A 12/1999 Pennini et al.
6,019,207 A 2/2000 Cole
6,053,299 A 4/2000 Rollins
6,125,988 A 10/2000 Waters
6,398,000 B1 6/2002 Jenrick et al.
6,493,461 B1 12/2002 Mennie et al.
6,628,816 B2 * 9/2003 Mennie et al. ..... 382/135
6,651,796 B2 * 11/2003 Chou ..... 194/350
6,742,645 B2 * 6/2004 Chou ..... 194/206

FOREIGN PATENT DOCUMENTS

WO WO 03/034355 A1 4/2003

* cited by examiner

*Primary Examiner*—Patrick Mackey
*Assistant Examiner*—Mark J. Beauchaine
(74) *Attorney, Agent, or Firm*—Welsh & Katz, Ltd.

(57) ABSTRACT

A method and apparatus are provided for authenticating a document. The apparatus includes a profile processor adapted to collect a plurality of data profiles from a suspect document, a comparator adapted to compare the plurality of data profiles with a set of envelopes of a library document and to determine that the document is authentic when the plurality of profiles conforms with the plurality of envelopes and a push-in lock that locks a cassette that holds authenticated documents to a body of the apparatus for authenticating the document.

20 Claims, 10 Drawing Sheets

UPPER HEAD ASSEMBLY

100

LOWER HEAD ASSEMBLY
52
IR / BLUE
52
IR / BLUE
56
SUPER
RED/BLUE
78
IR / SENSOR
VA-PCBA06-XX
LOWER SENSOR
BOARD
52
M
VA-PCBA06-XX
DIAGNOSTIC BOARD
CN2
CN3
VA-WIRA07-XX
VA-PCBA06-XX
UV SENSOR BOARD
OPTIONAL
VA-WIRA01-XX
26
UV
SD
CN1
28
PD
29

DOCUMENT VALIDATOR WITH LOCKING CASSETTE

BACKGROUND OF THE INVENTION

This application is a continuation of provisional patent application No. 60/457,153 filed on Mar. 24, 2003.

FIELD OF THE INVENTION

The field of the invention relates to document recognition and more particularly to currency validators.

Currency validators are generally known. Such devices are typically used on such devices as vending machines or slot machines to accept a limited scope or type of bill of a particular currency or coupons or bar codes.

Currency validators typically function by measuring an amplitude of light reflection at one or more positions of the bill and comparing the measured color with a predetermined value. If the measured value falls within a range of the predetermined value, then the bill is accepted as genuine. If the measured value exceeds the predetermined value, then the bill is rejected.

Other currency validators rely upon fluorescence. Currency validators of this type are typically hand-operated devices that detect the use of specially formulated fluorescent inks used by some countries in the printing of their currency.

In the case of currency validation based upon fluorescence, an ultraviolet light is directed at the bill and a level of fluorescence is measured. If the level of fluorescence is below a predetermined value then the bill is accepted.

Other currency validators may rely upon a combination of color measurement and fluorescence. While such systems are relatively effective, they lack the flexibility to cope with currency that has been defaced or is in poor condition. Accordingly, a need exists for a currency validator that is able to recognize and reliably accept a wide variety of currencies and currency conditions.

SUMMARY

Figure 1A:
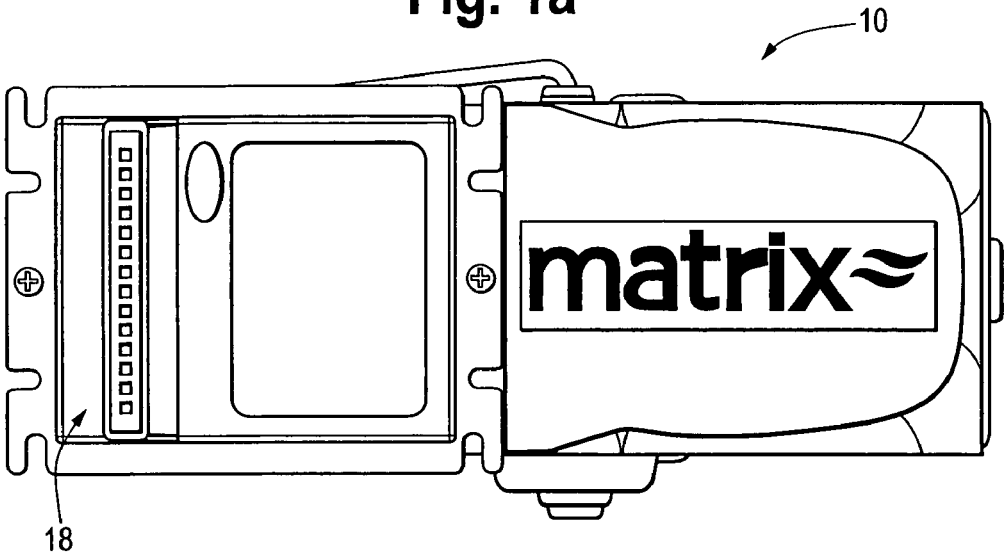
FIG. 1*a–b* are top and side views of a document validator in accordance with an illustrated embodiment of the invention.

A method and apparatus are provided for authenticating a document. The apparatus includes a profile processor adapted to collect a plurality of data profiles from a suspect document, a comparator adapted to compare the plurality of data profiles with a set of envelopes of a library document and to determine that the document is authentic when the plurality of profiles conforms with the plurality of envelopes and a push-in lock that locks a cassette that holds authenticated documents to a body of the apparatus for authenticating the document.

As used herein, measuring a metric of a suspect document means measuring a characteristic of the medium of the document. It does not mean measuring a width or thickness of the document. Further, measuring a characteristic of the medium of the document means measuring a characteristic of the substrate of the document or any substance printed thereon or any stamp, window or sticker permanently attached to the document.

Under one illustrated embodiment, the measured metric may be the reflected and transmissive qualities of the medium of the suspect document in response to an impinging infrared (IR), super red or blue optical signal. Under another illustrated embodiment of the invention, the measured metric may be the fluorescent signal emitted by the medium in response to an impinging ultraviolet (UV) signal. Under still another illustrated embodiment of the invention, the measured metric may be a magnetic level of the medium.

The measured metrics may be arranged into data profiles and compared with a corresponding set of envelopes of a library document to determine whether the suspect document is authentic. The envelopes may define upper and lower limits for the measured metrics of the suspect document. The determination of authenticity (also sometimes referred to herein as validating the document) may be based upon a comparison of the data profiles with a set of envelopes that define the library document and upon conformance of the data profiles with the set of envelopes. Conformance, in this case, means that the data profiles substantially lie between the upper and lower limits of the envelopes that define the library document.

The arrangement of the measured metrics into the data profiles may be based upon any method by which the distinctive features of a document may be captured. For example, under one embodiment the data profiles may be formed from data collected by signal format (e.g., magnetism of the medium, fluorescence of the medium, optical signal color and whether it is a reflected signal or a signal transmitted through the suspect document, etc.) and by position along a predetermined path across the document.

DETAILED DESCRIPTION OF AN ILLUSTRATED EMBODIMENT

The validator can be described as a system that identifies valid documents (e.g., currency) and functions to authorize some activity based upon the validation. For example, the validator may be used in a vending machine to accept currency and authorize the dispensing of food from the vending machine. As used herein, validation means determining that a document is authentic.

Figure 1B:
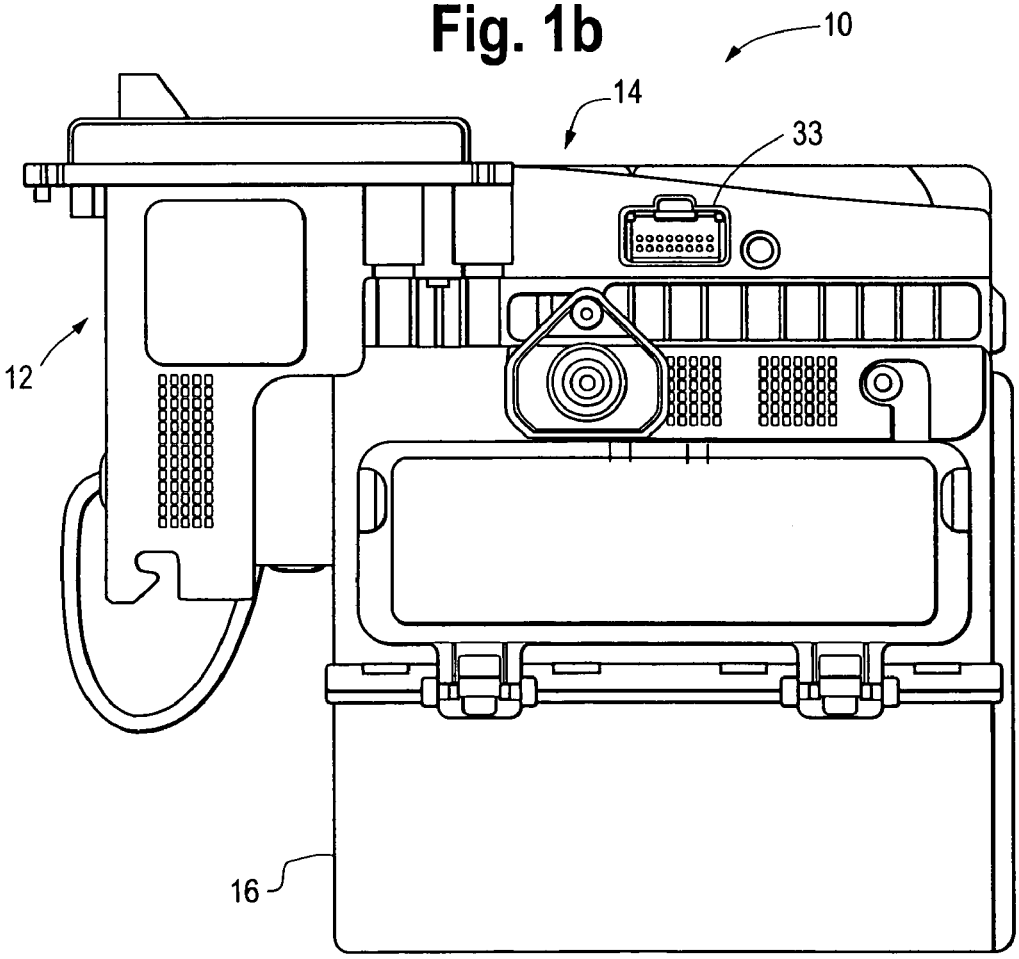

FIG. 1 depicts top and side views of a validator 10, shown generally in accordance with an illustrated embodiment of the invention. The validator 10 includes a sensor section 12, a transport system section 14 and a document cassette 16. Documents may be fed into an entrance slot 18 where it is detected by a set of IR sensors 78*a,b*. Detection by the IR sensors 78*a,b* activates the transport system.

Figures 6, 6A:
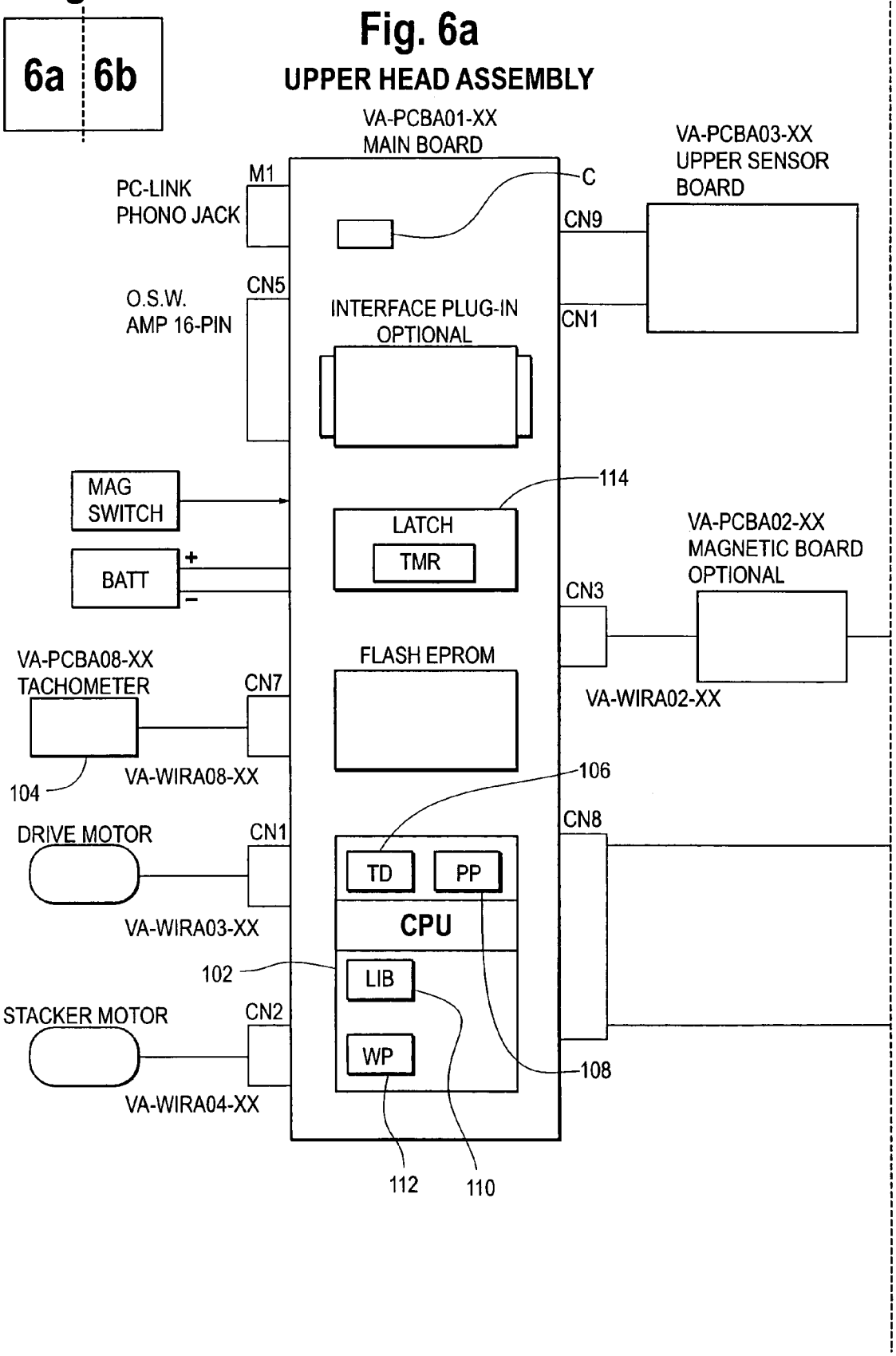
FIG. 6 depicts a control system that may be used by the system of FIG. 1.
Figure 6B:
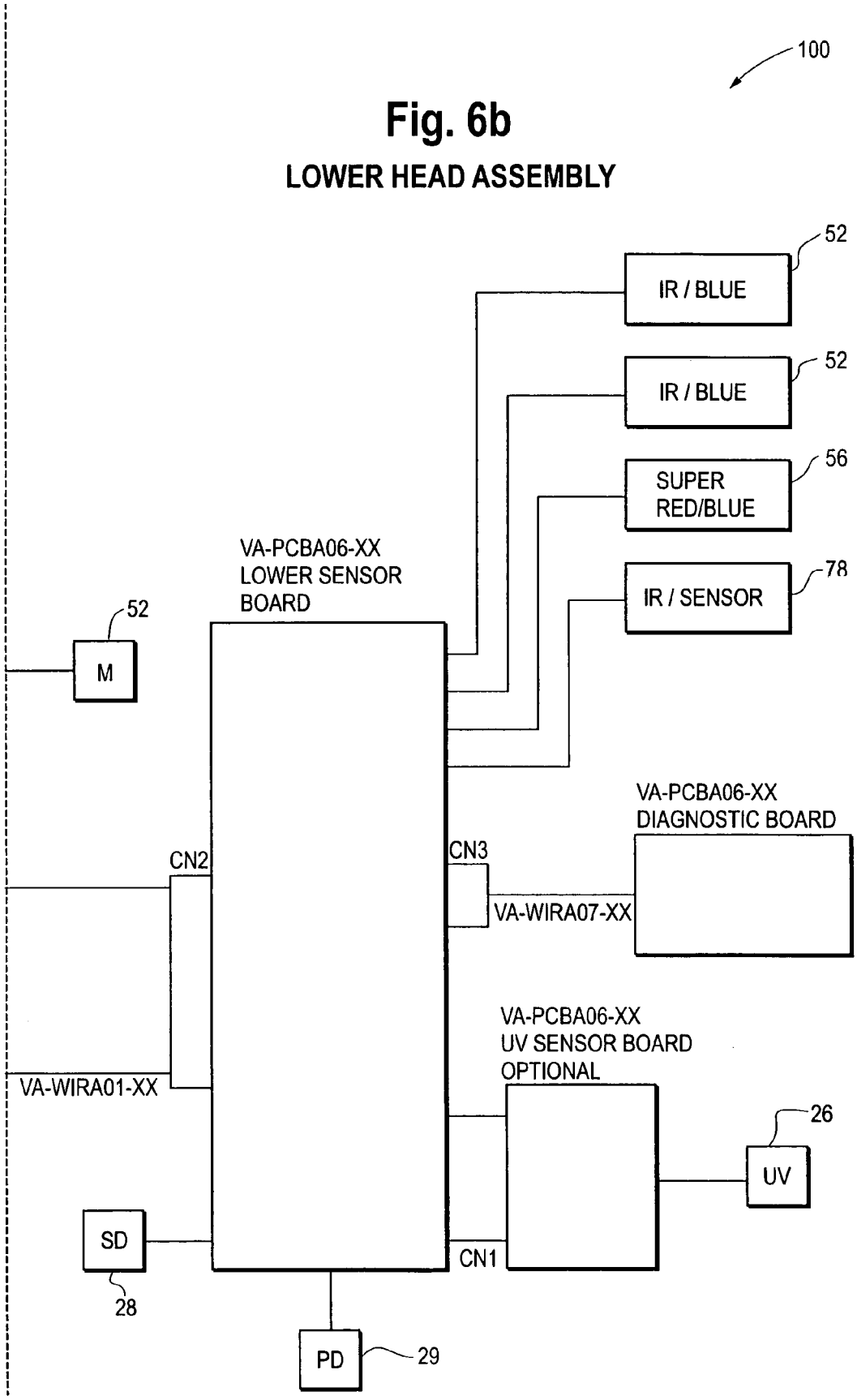
Figure 11:
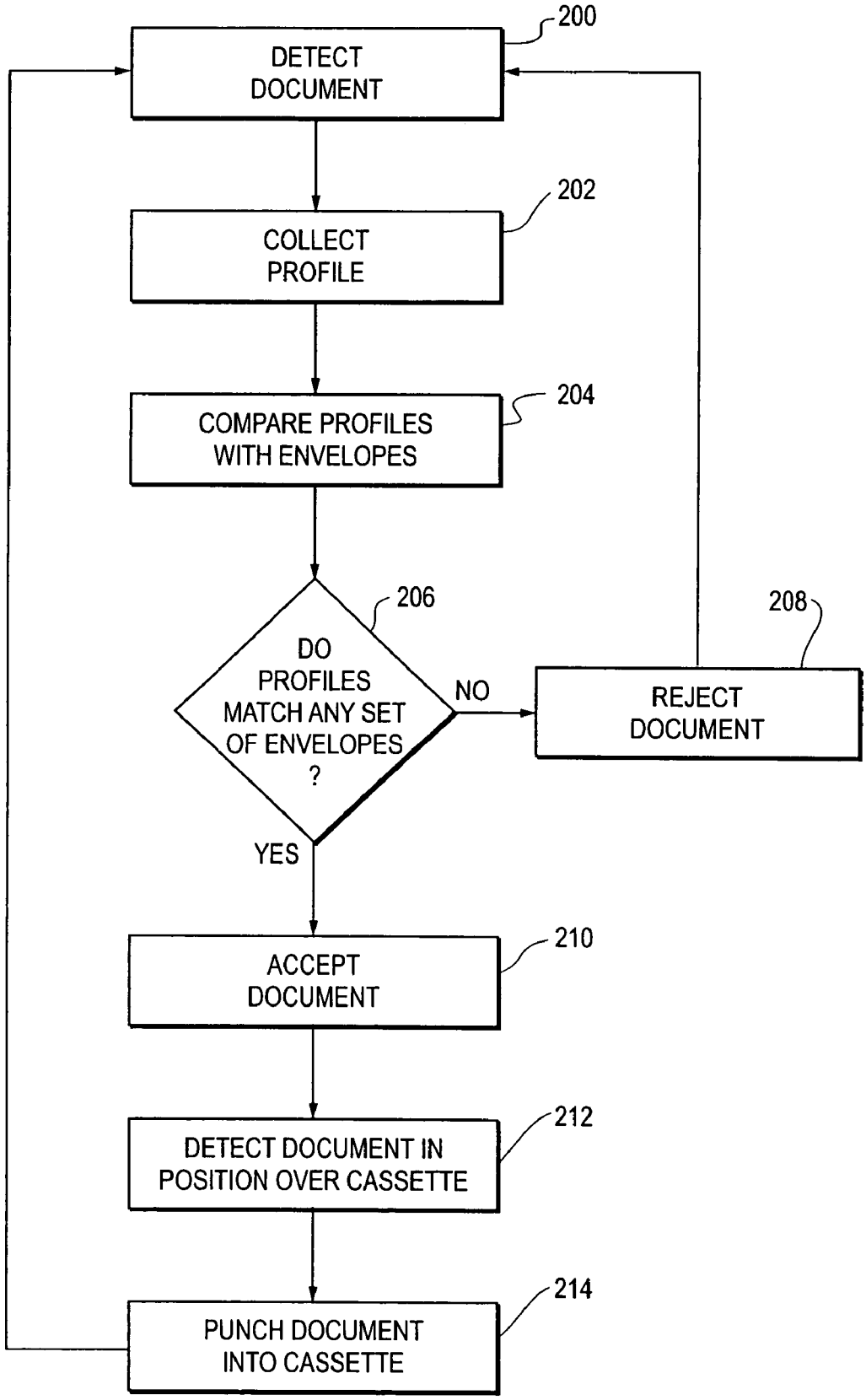
FIG. 11 is a flow chart of the method steps that may be used by the validator of FIG. 1.

FIG. 11 is a flow chart that depicts steps that may be followed by the validator 10 in determining the authenticity of a document. Reference may be made to FIG. 6 as appropriate to an understanding of the invention.

Figure 2:
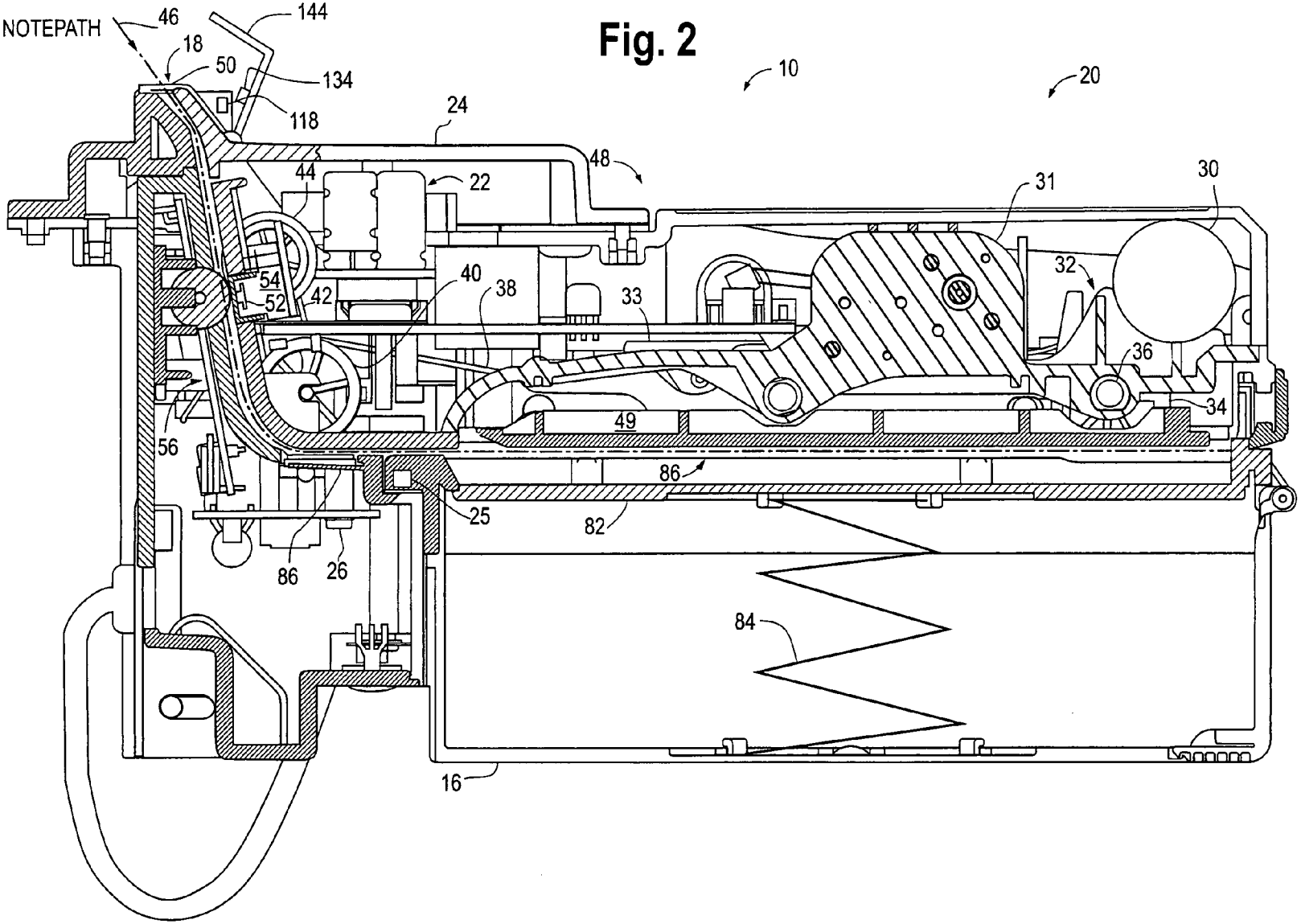
FIG. 2 is a cut-away view of the validator of FIG. 1.

FIG. 2 shows a cut-away side view of the validator 10. The transport section 14 contains a drive system 20 that moves a document through the validator. The drive system 20 generally includes a drive motor 30 that is directly coupled to a gear train 32. An output of the gear train 32 is directly coupled to a pair of head-end drive pulleys 34 mounted on a common shaft 36. A pair of continuous belts 38, equidistant from a centerline of a path of travel 50 of the document 46 and separated by a distance of at least 34 mm, pass over the head-end pulleys 34 and a set of tail-end pulleys 40. A secondary pair of belts 42, driven by the tail-end pulleys 40 drives a pair of initial drive capstans 44. The drive system functions to transport a document 46 inserted into the slot 18 through the validator 10 along the note path 50.

The transport system 20 moves the document 46 past a number of arrays of sensors within the sensor section 12. The sensors function to detect 100 the presence of a document 46 as well as provide information sufficient to identify a type of document and to establish whether the document is authentic. Once the type of document has been identified and accepted as authentic, the transport system moves the document to an area adjacent a cassette 16. A stacking system 48 functions to stack the document into the cassette.

The arrays of sensors may include a set of profiling sensor arrays, anti-stringing sensors, an ultraviolet (UV) sensor and a timing and position sensor. The profiling sensors include a magnetic sensor 54 that is centrally located adjacent a flat side of the document path 50 and a set of spaced-apart IR/blue sensor arrays 52 located on either side of the magnetic sensor 54 (one sensor array 52 shown in phantom in FIG. 2). Following the IR/blue sensors 52 is a centrally-located super red/blue sensor array 56. (As used herein, a super red optical signal is a visible optical signal adjacent the infrared spectrum). As each document passes through the profiling section of the validator 10, a profile of the document 46 is collected 202 along the length of the document 46 based upon position by each sensor array. A profile of the document is a succession of readings of the same signal type along some predetermined path across a portion of the document.

Figure 3:
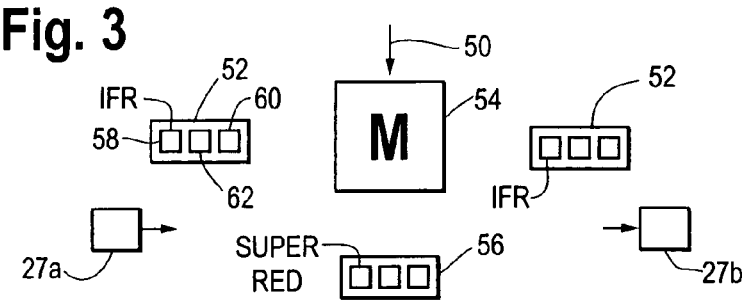
FIG. 3 is a plan view of the sensor arrays of the validator of FIG. 1.
Figure 4:
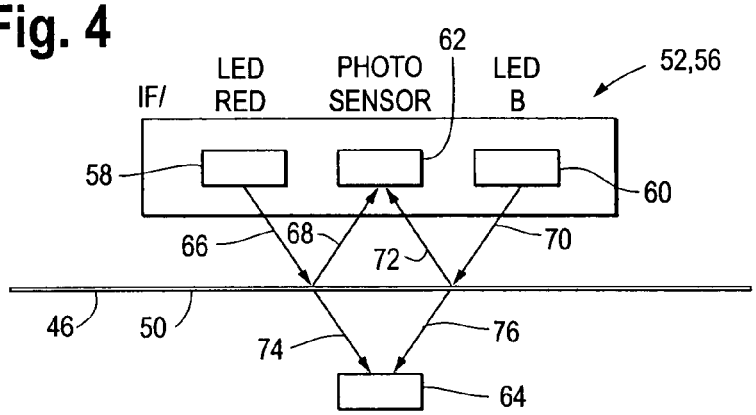
FIG. 4 depicts optical transmission paths of the sensor arrays of FIG. 3.

FIG. 3 shows a plan view of the sensor 52, 54, 56. FIG. 4 shows a functional view of a IR/LED sensor array 52 in terms of optical transmission and detection.

Figure 7:
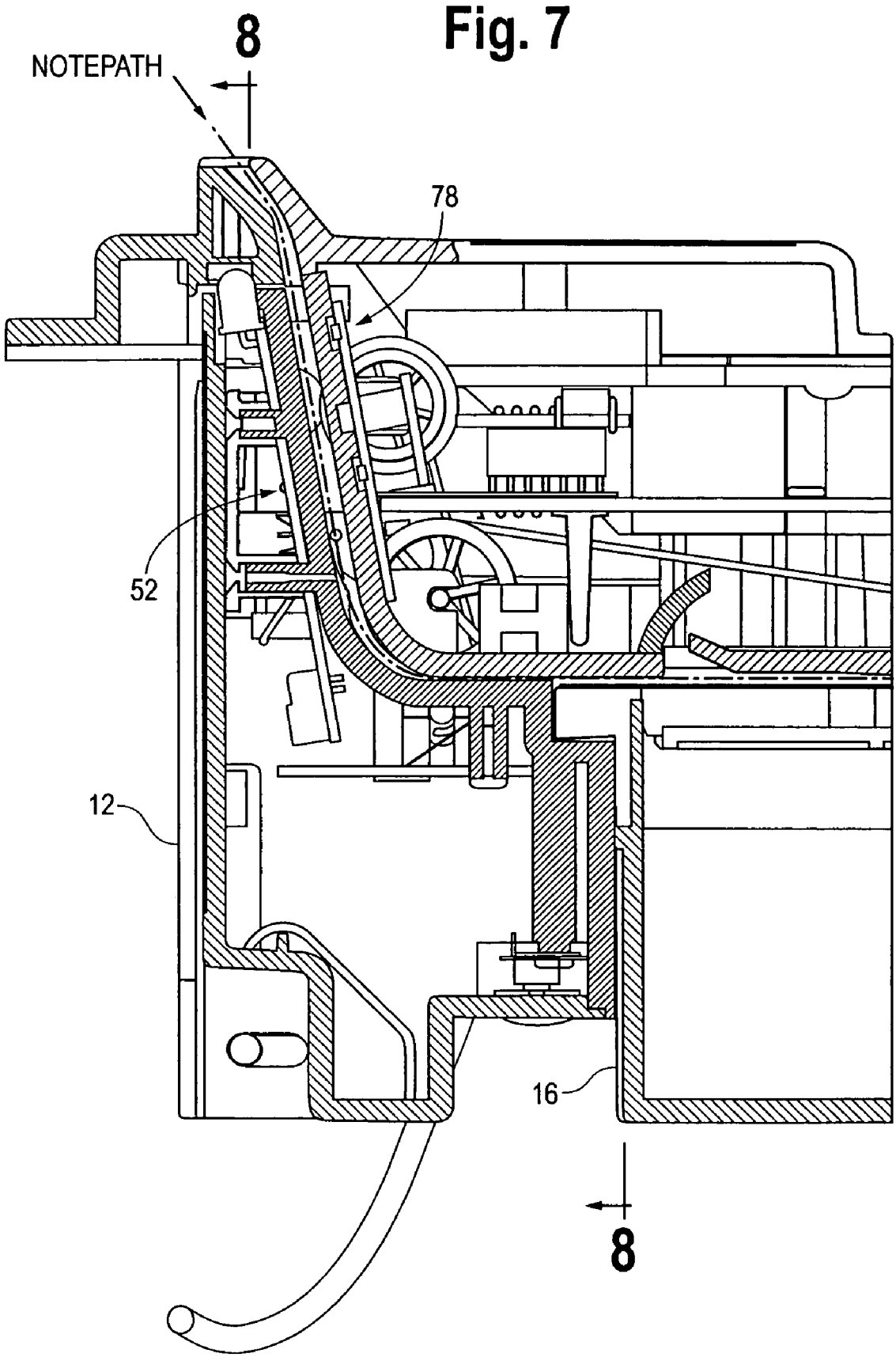
FIG. 7 shows a simplified cut-away view of FIG. 2.
Figure 8:
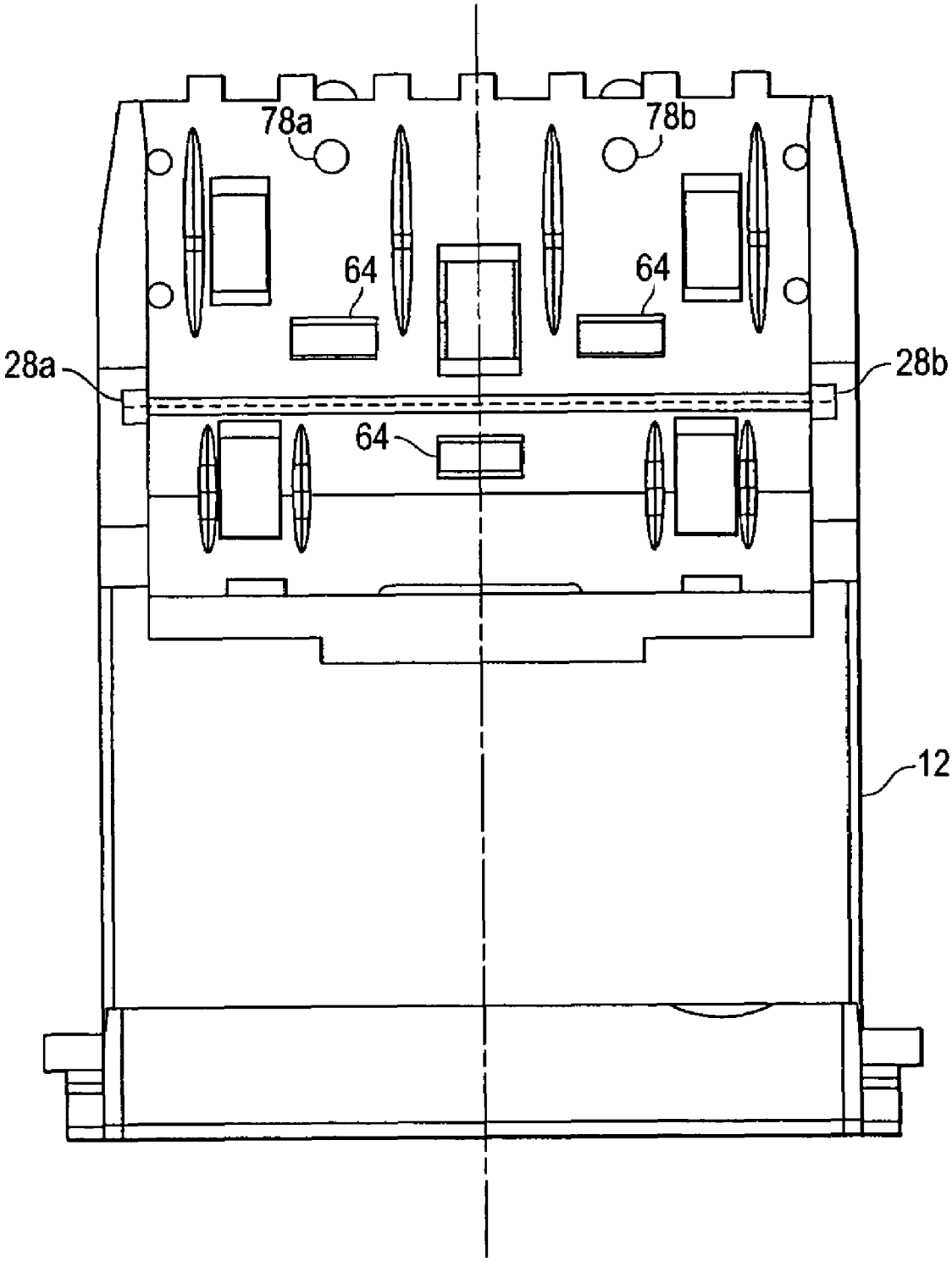
FIG. 8 shows a section view of FIG. 7.
Figure 9:
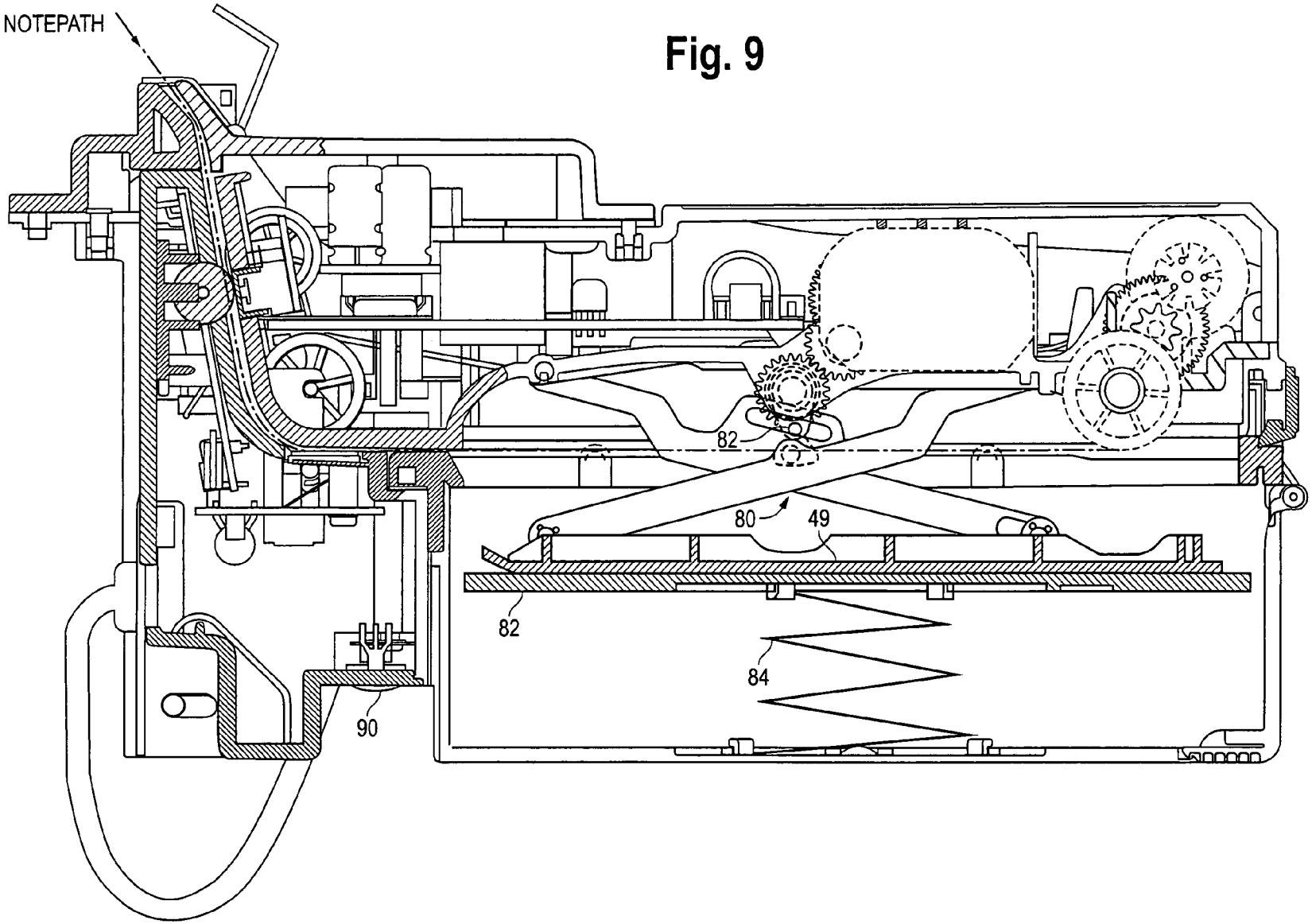
FIG. 9 depicts a document stacking mechanism that may be used by the validator of FIG. 1.

FIG. 7 shows a simplified cut-away view of a left portion of the validator 10 of FIG. 2. FIG. 8 shows a section view of the sensor section 12 of the validator 10 along lines 8—8.

Each IR/blue sensor array 52 includes an IR light emitting diode (LED) 58 and a blue LED 60 (FIG. 3). The array 52 also includes a first photodetector 62 on the same side of the document path as the IR LED 58 and blue LED 60 and located between the IR and blue LEDs 58, 60. A second photodetector 64 is located on an opposing side of the document path opposite the first photosensor 62.

A profile processing unit 108 of a control system 100 (shown in FIG. 6) of the validator 10 alternately activates the IR LED 58 to generate an IR optical signal 66 and then the blue LED 60 to generate a blue optical signal 70, each for a predetermined time period. During the time that the IR LED is activated, the processor 108 measures the IR signal detected by the first and second photodetectors 62, 64. The first photodetector 62 measures a reflected IR signal 68. The second photodetector 64 measures the transmitted signal 74 that passes through the document 46.

After measuring the IR signal, the processor 108 deactivates the IR LED 58 and activates the blue LED 60 and repeats the measurements. As above, the first photodetector 62 measures a reflected blue signal 72. The second photodetector 64 measures the attenuated signal 76 that passes through the document 46.

Similarly, the processor 108 alternately activates the super red LED and blue LED of the super red/blue array 56. The array 56 may have the same configuration and operate in substantially the same way as described with respect to FIG. 4. During the time that the super red LED is active, the processor 108 measures the reflected and transmitted super red energy on a first and second side of the document path. During the time that the blue LED is active, the processor 108 measures the reflected and transmitted blue energy on a first and second side of the document path.

As the transport system 20 moves the document 46 past the IR/blue sensor arrays 52 and the super red/blue sensor arrays 56, the processor 108 collects data 202 as described above. The processor 108 also collects data from the magnetic sensor 54. As the document moves past the arrays, a tachometer 104 measures a speed of the document past the arrays of sensors. By detecting the instant of entry of the document 46 into the validator 10 and knowing the speed of the document, the processor 102 may correlate each array and magnetic sensor reading to a position on the document. The data samples collected from each sensor may be concatenated together based upon the position on the document where it was collected to form the profile from that sensor and sensor array.

Figure 5A:
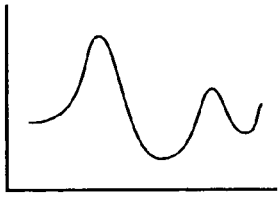
FIG. 5 depicts optical profiles provided by the arrays of FIG. 3.
Figure 5B:
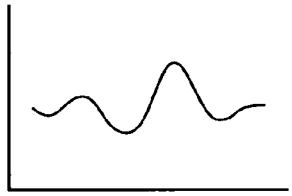
Figure 5C:
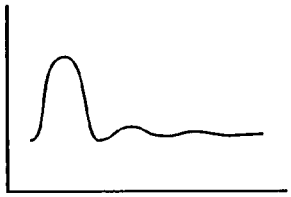
Figure 5D:
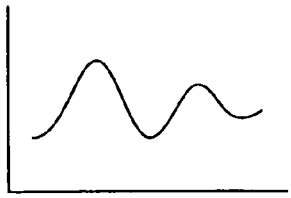

FIGS. 5*a*–*e* shows examples of data profiles that may be collected by the detectors 62, 64 of the IR/blue arrays 52 and super red/blue arrays 56. FIG. 5*a* shows an example of a profile of the reflected IR or super red energy measured by the detector 62 while FIG. 5*c* shows an example of a profile of the transmitted IR or super red energy measured by the detector 64. FIG. 5*b* shows an example of a profile of the reflected blue energy measured by the detector 62 and FIG. 5*d* shows an example a profile of the transmitted energy measured by the detector 64.

Figure 5E:
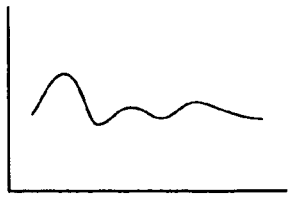

FIG. 5*e* shows an example of a difference profile that may be generated by the processor 108. The difference profile of FIG. 5*e* may be generated by subtracting the measured blue energy at each point from the IR or super red energy of an adjacent point on the document 46.

The profiles from the magnetic sensor 54, IR/blue sensor arrays 52 and super red sensor array 56 together form a set of profiles that may be used to validate the document. The set of profiles obtained from each document is compared 204 with a set of respective profile envelopes for a valid document to determine the authenticity of the document.

For example, if a number of U.S. dollar bills were to be passed through the validator, the set of profiles for each dollar bill would be very similar, but not identical. The variations among the dollar bills at identical points defines a range of valid readings at that point. The range of valid readings along the length of the dollar bill can be concatenated to form an envelope for a valid dollar bill for each sensor type. The envelopes formed by each sensor for the dollar bill together form a library document defined by a set of envelopes that can be used to validate suspect dollar bills.

In addition, a library document can be created to validate a dollar bill no matter which way it is inserted into the validator. One set of envelopes may be created with Washington's image on the upper side facing to the right and another set of envelopes may be created with Washington facing the left (i.e., the bill turned end-for-end). A third and fourth set of envelopes may be created for the dollar bill with Washington's image facing downwards and inserted into the validator first one way and then turned end-for-end.

Further, a similar set of envelopes may be created for U.S. five dollar bills, ten dollar bills, fifties and one-hundreds. Similar sets of envelopes may also be created for foreign currencies or even coupons or redemption tickets.

Included within the validator may be a library of sets 110 of envelopes for valid documents (e.g., currency). Under one embodiment, the validator may contain a library for eleven different currency types in four different directions thereby providing a library of 44 library documents, each defined by a different sets of envelopes.

Included with each set of envelopes may be a commonly-used identifier of the associated library document (e.g., a U.S. one-dollar bill, eurodollar, etc.) As the validator reads and processes each document, a processor within the validator matches the set of profiles of each suspect document with sets of envelopes of the valid library documents within memory. Matching a profile with a corresponding envelope means determining that the measured metric falls within the upper and lower limits of the envelope. Where a match is found, the suspect document may be accepted as a validated member of the set of documents identified by the commonly-used identifier (e.g., a U.S. one dollar bill).

The matching of the set of profiles of the suspect document may be accomplished under a number of different methods. Under one method, one or two pilot profiles of the set of profiles may be selected and compared with respective envelopes within the library documents to give a first estimate of the best matches. The pilot profile(s) may be selected based upon experience in providing a first good indication of identity.

Once the best matches have been identified, a more rigorous comparison may be made between the remaining profiles of the suspect document and the remaining set of envelopes of the matched library documents. By using the pilot profile as a first level of matching, the processing time for validation can be considerably reduced.

Under another embodiment, each positional value of each profile may be successively compared with corresponding positional values of the sets of envelopes of the library documents. If the values of each profile of the suspect document falls within the ranges of each envelope of the set of envelopes of one particular library document, then the match is strong evidence that the suspect document is a valid member of that particular library document.

Alternatively, a percentage value may be formed for each of the profiles of the suspect document with corresponding envelopes of the library documents. The use of percentage values may be useful in the case of defaced currency or currency with foreign materials (e.g., mending tape, ink marks, etc.) disposed on the currency.

In this case, each value at each position of a profile may be compared with the range of values of a respective position and respective envelope of the valid documents and a percentage of matching points may be calculated within the processor 102. The percentage match among the envelopes of the set of envelopes may be averaged to form an average percentage of match with each library document of the library. The library document with the greatest average percentage match to the suspect document may be selected as the set within which the suspect document most likely falls, subject to some minimum threshold value.

Alternatively, a curve matching routine may be used to match each profile of the suspect document with respective envelopes of the library documents. In this case, some mathematical or statistical formula (e.g., based upon standard deviation) may be used as evidence of a match.

As further evidence of authenticity, the UV sensor 26 may be used. In this case, it has been found that fluorescence of the document may be a counter indicator of authenticity. More to the point, prior art validators have relied upon a measurement of a level of fluorescence as an indicator of validity. The fluorescence may be provided by fluorescent inks that are used on some government-issued currencies.

However, it has been found that counterfeit documents often use paper that also provides a high level of fluorescence when subjected to UV. What has not been noted in the prior art is that valid documents fluoresce in a very narrow frequency range whereas counterfeit documents fluoresce over a relatively broad frequency range. To overcome this deficiency and provide an improvement over prior art methods, the validator described herein may use a bandpass filter 86 to suppress the fluorescence within the narrow range (in the yellow to green region) produced by valid documents. A threshold detector 106 may then by used by the processor 102 to detect fluorescence that exceeds a threshold value outside that range as a means of identifying invalid documents.

The validation of a suspect document may be based on a combination of profile processing and UV sensing. UV sensing may involve the use of an absolute threshold or a variable threshold that depends upon a position of a reading on the document or in a fluorescent profile. The final determination of authenticity may be based on a set of threshold values in the profiles processed and also upon a set of weights assigned by a weighting processor 112. For example, the threshold for at least some of the profiles processed may be set such that the profiles of the suspect document must fall within the respective envelope of the set of envelopes of a library document and be given a higher weighting factor. Alternatively, the threshold for other profiles processed may be set at some lower value to accommodate some level of defacing of the document and be given a lower weighting factor. Similarly, the UV threshold may be set at some constant level or adjusted upwards or downwards to accommodate environmental factors (e.g., sunlight entering the slot 18). In any case, once the suspect document has been found to be within the thresholds and the sum of the weights exceed some weighting threshold, the suspect document 46 may be accepted as having been validated.

Once a document has been validated, the environment of the document between arrays 52 and 56 may be examined to verify that there are no strings attached. As is known, prior art bill validators may be defeated by attaching strings to bills and using the string to pull the bill out of the validator once the bill has been accepted.

In this case, an adjustable IR transmitter 28*a* and receiver 28*b* may be used to detect the presence of tape or strings. The transmitter and receiver 28 may be arranged to operate parallel with a predominant plane of the document and to transmit the detection signal through the path 50 of the document 46. A threshold value may be used to avoid false readings due to environmental factors (e.g., sunlight). Acception or rejection may occur based upon the above criteria and upon the processor 102 detecting a signal from the receiver 28*b* (indicated that there are no strings attached) after the document 46 has reached the cassette.

Once the document 46 has been authenticated and it has been determined that no strings are attached, then the validator 10 may transmit notification of receipt and acceptance of the document using the commonly accepted terminology of the matching library document. Notification of validation may be sent by operation of the interface module 22 (discussed in more detail below). The validator 10 may also then insert (i.e., stack) the document into the cassette 16.

To determine a timing of the stacking cycle, an IR transmitter 27*a* and receiver 27*b*, located on a first side of the document path may be used in conjunction with a light pipe 25 disposed on an opposite side of the document path. The transmitter and receiver transceive an optical signal perpendicular to a predominant plane of the document 46.

The difficulty in the prior art of determining document position above the cassette 16 has been the presence of transparent windows in some foreign currencies (e.g., Australian). The transmitter 27*a* solves this problem by transmitting an optical signal through one portion of the document path 50 and the detector 27*b* detects the signal transmitted through a different portion of the document path 50. A light pipe on an opposite side of the document path transfers light from the transmitter 27*a* location laterally to the receiver 27*b* location.

Further, the light pipe is embedded in the cassette. Embedding the light pipe in the cassette allows the light pipe to also function as a detector for the presence of the cassette.

The document path of the validator is designed for documents up to 72 mm wide and approximately 160 mm long. However, many documents are much narrower than 72 mm. In order to transport documents from an entrance of the validator to the cassette, the pairs of rollers 44 and belts 38 are provided that are placed approximately 16–18 mm from the edges.

Upon insertion of a document, the pair of roller 44 initially engage and transport the document past the magnetic, IR/blue and super red/blue sensors. After the document passes the super red/blue sensor, the document engages the pair of belts 38 where it is transported past the UV sensor and to the area above the cassette and below the stacking plate 49.

As the document 46 reaches the area above the cassette, the position detector 29 sends a signal to the processor 102. The processor 102, in turn, activates the stacking motor and gear box 31 that, through the use of an drive pin 80 and scissors assembly 80 cause the stacking plate 49 to extend and retract.

By operation of the stacking motor 31 and scissors assembly 80, the stacking plate 49 pushes the document into the cassette through an aperture 86 on the upper surface of the cassette. Within the cassette, a carrier plate 82 and spring 84 function to receive the document 46 and via operation of the spring 84 cause the accumulated documents to assume a stacked format.

The stacking plate 49 occupies the area above the path 50 between the belts and is, therefore, much narrower than the document. As used herein, pushing or plunging the document into the cassette means pushing the document (perpendicular to the predominant plane of the document) through the aperture in an upper surface of the cassette where the aperture has a peripheral distance that is less than that of the document. As used herein, the predominant plane of the suspect document means that plane of the document defined by the thickness of the document or, stated differently, the predominant plane of the document lies parallel to and within the thickness of the document.

For example, the cassette may have an aperture that is approximately 160 mm long and a width of approximately 45 mm. As such, the peripheral distance of the aperture is approximately 410 mm.

In order to ensure the perpendicular translation of the predominant plane of the document from the document transport path into the cassette without lateral movement, the stacking plate may be provided with an anti-slip surface. Under one embodiment, the anti-slip surface may be obtained by disposing an area of silicone-rubber on opposing ends of the stacking plate. Under one embodiment, the area of silicon-rubber may be provided in the form of a number of silicon-rubber bumps disposed within a series of apertures (e.g., 5) proximate each end of the stacking plate. The silicon-rubber bumps may be provided by injecting the silicone-rubber into the apertures in such a way that the silicone-rubber extends above an active surface of the stacking plate by an appropriate distance (e.g., 1 mm).

Under one embodiment, the cassette has sufficient depth to accept up to 250 documents. Under other embodiments, the cassette may have sufficient depth to accept 600 or 1,000 documents.

The cassette may be provided with a pair of outwardly extending support pins on each side of the cassette. The validator may be provided with a complementary set of locking channels to accept the cassette. Locking of the cassette to the validator body may occur by lateral movement of the cassette parallel to the document path that lies immediately above the cassette.

Figure 10:
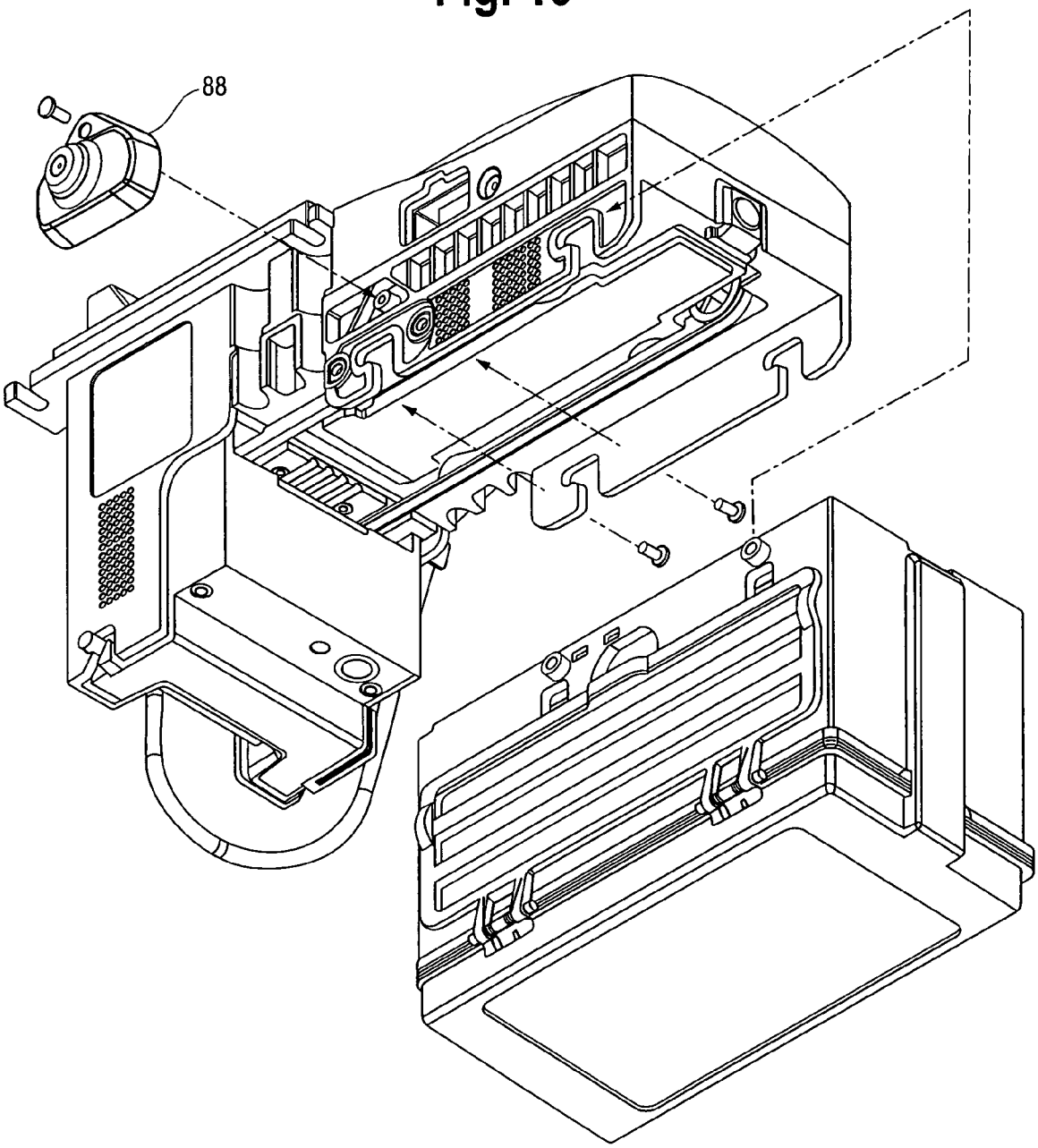
FIG. 10 depicts a locking assembly that may be used with the validator of FIG. 1.

The cassette may also be provided with an optional push lock 88 (FIG. 10) secured by a set of screws inserted from inside the validator stacking chamber to prevent removal of the cassette from the validator. The push lock may be of value in allowing a progressive level of security provided within a device relying upon the validator. For example, in vending machines, one level of personnel is allowed access to the interior of the vending machine for filling and servicing the machine while another level of personnel is allowed access for emptying the cassette. Because of the trusted level of any personnel allowed within the device, the push lock does not need the mechanical strength that would be otherwise required of an external lock. More specifically, the purpose of the push lock is not to provide mechanical resistance to force, but to provide a locking mechanism that cannot be easily defeated without leaving physical evidence of tampering.

The push lock differs from the prior art in that the push lock is not related to the standard cam lock of the prior art. In contrast, the push lock of the validator simply mounts to the validator body and is provided with an movable cylinder that may be pushed in the direction of key insertion to a locking position. The pushing of the cylinder advances a connected peg into the locking channel behind the pins of the cassette to prevent removal of the cassette from the validator.

In order to accommodate a variety of interface requirements of the environments where the validator is used, a replaceable interface module 22 (FIG. 2) may be provided for the validator. The interface module 22 may be mounted inside the validator 10 behind an easily removable face plate 24. The interface module may be used to accommodate a variety of voltages from external sources that supply power to the validator and also a variety of interface data formats that may be required by systems that rely upon the document validator. For example, the validator may be used in gaming machines (e.g., slot machines), vending machines or entry control devices (e.g., ticket validating devices for a concert or movie). In the case of a slot machine or entry control devices, a power supply voltage may be 12 volts, while for a vending machine, the supply voltage may be 24–42 volts. Further, a slot machine may require a data interface in the form of a USB connection while a vending machine may require a multi-drop bus (MDB) interface.

To accommodate the interface environment, the interface module may be provided as a printed circuit board (PCB) with a five pin receptacle on one end and a six pin receptacle on an opposing end. An opposing male portion of the five and six pin connectors may be provided on a main circuit board of the validator. The opposing male portions provide structural support for the interface module and provide a mechanism for easily replacing the module with another module adapted to accommodate a new operating environment.

Signal and power connections may be intermixed within the five and six pin connectors. Alternatively, the five pin connector may be used for supplying power to the validator while the six pin connector may be used to provide a data interface requirements. An external sixteen-pin male connector 33 may be provided on an external surface of the validator to receive power from the external source and provide data to connected devices. Predefined pins on the external connector and five and/or six pin connector may be dedicated to supplying power to the validator. Similarly, predefined pins on the external connector and five and/or six pin connector may be dedicated to the data interface format required for external devices to communicate with the validator.

In the case where the validator is to be installed in a vending machine with a 24–42 volt power supply and an MDB data exchange format, at least a first portion of the interface module would be dedicated to a power supply that would accept the 24–42 volts as an input and to reduce the 24–42 volts to a voltage useable by the validator (e.g., using a switching power supply). Similarly, a second portion of the interface module would be devoted to a set of drivers that allow the external device to communicate with the validator using the MDB format.

Alternatively, where the validator is to be installed into a local area network (LAN), then the first portion of the interface modules dedicated to supplying power to the validator may be much simpler and, in fact, may simply be a set of connecting links if the external source provides power at the same voltage as that required by the validator. The second portion of interface module, however, may be somewhat more complicated.

Alternatively, the validator may be interconnected with external devices using a USB connector. In this case, the second portion of the interface module may require a USB processor to allow the validator to register and exchange data with connected devices under the USB format. Further, an external connector in the form of a USB connector may also be needed in place of (or in addition to) the 16-pin connector.

In this case the USB processor may be programmed to accept and/or transmit formatted self-descriptive information packets or HID report descriptors as described in "The Device Class Definition for Human Interface Devices, Firmware Specification", Version 1.0—Final, USB Implementers Forum, 1997. An interpretive software module within a host computer of any connected device contains and/or uses a library of pre-defined peripheral device archtypes, data structure building rules and signal handling protocols.

The use of the USB processor allows validators 10 to be installed within other devices (e.g., slot machines) at will without the necessity of activating any software routines to install the validator 10 on the host. In this case, the validator 10 (through the USB processor and interface) automatically registers with the host upon startup and may periodically transfer status messages to the host. Further, the use of the USB interface allows a game system architect to obviate the need for a communications hub and a microcontroller to service each validator 10.

In another embodiment of the invention, the validator is provided with a reset function that avoid false resets based on careless handling of the validator when activated. In order to avoid false resets, the validator provides a time delay associated with the reset button 90. In order to activate the reset button, a user may be required to press and hold the reset button in a depressed state for a predetermined time period (e.g., 4 seconds) before a reset may be executed.

A specific embodiment of a document validator has been described for the purpose of illustrating the manner in which the invention is made and used. It should be understood that the implementation of other variations and modifications of the invention and its various aspects will be apparent to one skilled in the art, and that the invention is not limited by the specific embodiments described. Therefore, it is contemplated to cover the present invention and any and all modifications, variations, or equivalents that fall within the true spirit and scope of the basic underlying principles disclosed and claimed herein.

The invention claimed is:

1. An apparatus for authenticating a document comprising:

a body;

a profile processor disposed within the body and configured to collect a plurality of data profiles from a suspect document;

a comparator disposed within the body and configured to compare the plurality of data profiles with a respective envelope of set of envelopes of a library document and to determine that the document is authentic when the plurality of profiles conforms with the plurality of envelopes;

a cassette that holds authenticated documents, the cassette secured to the body via a set of outwardly extending support pins;

a push-in keyed security keylock that locks the cassette to the body of the apparatus for authenticating the document and where the push-in keyed security keylock is not a cam lock; and a connecting peg operably connected to the push-in security keylock that is advanced into a locking channel behind a pin of the outwardly extending support pins of the cassette to prevent removal of the cassette from the body.

2. The apparatus for authenticating the document as in claim 1 further comprising the push-in lock being disposed on the body of the apparatus for authenticating the document.

3. The apparatus for authenticating the document as in claim 1 further comprising a pair of parallel flanges extending from opposing sides of the apparatus that together define a receptacle between the flanges for receiving the cassette.

4. The apparatus for authenticating the document as in claim 3 further comprising a plurality of slots disposed in the flanges for receiving a complementary set of pegs disposed on opposing outer surfaces of the cassette.

5. The apparatus for authenticating the document as in claim 4 further comprising the push-in lock being disposed on an outer surface of the flanges over a slot of the plurality of slots so that when the push-in lock is pushed in a peg of the push-in lock blocks the slot thereby preventing removal of the cassette.

6. The apparatus for authenticating the document as in claim 1 further comprising a plurality of sensors adapted to measure a plurality of metrics of a suspect document.

7. The apparatus for authenticating the document as in claim 6 wherein the plurality of metrics further comprises at least two of the group consisting of reflected optical signals, transmitted optical signals, magnetic signals and fluorescent signals.

8. The apparatus for authenticating the document as in claim 7 further comprising alternately measuring optical signals of a first and second optical frequency range with a single optical detector.

9. The apparatus for authenticating the document as in claim 8 wherein the step of alternately measuring the optical signals further comprises activating a first optical transmitter in the first frequency range and a second optical transmitter in the second frequency range.

10. The apparatus for authenticating the document as in claim 9 wherein the step of measuring the first and second optical signal with the single optical detector further comprises disposing a first optical detector on a first side of the suspect document between the first and second optical transmitter for detecting reflected optical signals.

11. The apparatus for authenticating the document as in claim 10 wherein the step of measuring the first and second optical signal with the single optical detector further comprises disposing a second optical detector on a second, opposing side of the suspect document for detecting optical signal transmitted through the suspect document.

12. An apparatus for authenticating a document comprising:

a body;

a plurality of sensors configured to measure a plurality of respective metrics from different respective transverse locations across a path of a suspect document;

a profile processor configured to arrange the metrics into a plurality of data profiles;

a comparator configured to compare the plurality of data profiles with a set of envelopes of a library document;

a weighting processor configured to determine that the document is authentic when the plurality of profiles conforms with the plurality of envelopes;

a cassette that holds authenticated documents, the cassette secured to the body via a set of outwardly extending support pins;

a push-in keyed security lock that locks a document cassette to the body of the apparatus said push-in lock being mounted to an outer surface of the body of the apparatus; and a locking pin of the push-in lock advanced by activation of the push-in lock into an engagement channel behind a pin of the outwardly extending support pins of the cassette to prevent removal of the cassette from the body and where the push-in keyed security lock is not a cam lock.

13. The apparatus for authenticating the document as in claim 12 further comprising a pair of parallel flanges extending from opposing sides of the apparatus that together define a receptacle between the flanges for receiving the cassette.

14. The apparatus for authenticating the document as in claim 13 further comprising a plurality of slots disposed in the flanges for receiving a complementary set of pegs disposed on opposing outer surfaces of the cassette.

15. The apparatus for authenticating the document as in claim 14 further comprising the push-in lock being disposed on an outer surface of the flanges over a slot of the plurality of slots so that when the push-in lock is pushed in a peg of the push-in lock blocks the slot thereby preventing removal of the cassette.

16. The apparatus for authenticating the document as in claim 15 wherein the plurality of metrics further comprises at least two of the group consisting of reflected optical signals, transmitted optical signals, magnetic signals and fluorescent signals.

17. The apparatus for authenticating the document as in claim 16 further comprising alternately measuring optical signals of a first and second optical frequency range with a single optical detector.

18. The apparatus for authenticating the document as in claim 17 wherein the step of alternately measuring the optical signals further comprises activating a first optical transmitter in the first frequency range and a second optical transmitter in the second frequency range.

19. The apparatus for authenticating the document as in claim 18 wherein the step of measuring the first and second optical signal with the single optical detector further comprises disposing a first optical detector on a first side of the suspect document between the first and second optical transmitter for detecting reflected optical signals.

20. The apparatus for authenticating the document as in claim 19 wherein the step of measuring the first and second optical signal with the single optical detector further comprises disposing a second optical detector on a second, opposing side of the suspect document for detecting optical signal transmitted through the suspect document.

* * * * *